United States Patent [19]

Pritchard

[11] Patent Number: 4,583,376

[45] Date of Patent: Apr. 22, 1986

[54] FREEZER/REFRIGERATOR AND REMOVABLE FOOD MODULE FOR USE THEREIN

[76] Inventor: Gloria C. Pritchard, 5909 Cates, Apt. 2E, St. Louis, Mo. 63112

[21] Appl. No.: 720,182

[22] Filed: Apr. 5, 1985

[51] Int. Cl.[4] ..... F25D 25/02

[52] U.S. Cl. ..... 62/382; 62/441; 62/442

[58] Field of Search ..... 62/440, 441, 442, 447, 62/336, 337, 378, 382; 312/236

[56] References Cited

U.S. PATENT DOCUMENTS

| | | | |
|---|---|---|---|
| 1,014,329 | 1/1912 | Pons | 62/457 X |
| 1,348,461 | 8/1920 | Washington | 62/250 X |
| 1,628,083 | 5/1927 | Vogt | 62/441 X |
| 2,233,394 | 3/1941 | Ashbaugh | 62/441 X |
| 2,386,919 | 10/1945 | Tobey | 62/442 |
| 2,470,956 | 5/1949 | Savidge | 62/441 |
| 2,928,262 | 3/1960 | Litman | 62/441 X |
| 3,058,320 | 10/1962 | Foster et al. | 62/382 |
| 3,203,199 | 8/1965 | Stewart | 62/441 X |
| 3,357,201 | 12/1967 | Toyama | 62/382 |
| 3,359,751 | 12/1967 | Stevens | 62/441 X |

*Primary Examiner*—Lloyd L. King

*Attorney, Agent, or Firm*—Kalish & Gilster

[57] ABSTRACT

A refrigerator, particularly the type having a frozen compartment, having a front door and at least one refrigerated module compartment accessible when the door is opened, the compartment receiving a removable food module. The module is divided both horizontally and vertically into a plurality of tray compartments, the vertical divisions corresponding to a multiplicity of consecutive days in a period. Such tray compartments are marked with indicia for designating the days in the period corresponding to the respective tray compartments. Trays are provided for the tray compartments, preferably in stacked configuration within each tray compartment, with each tray having food for preparation on the day designated for such tray compartment. Accordingly, the module may be removed at the end of the period and replaced with a like module containing food for a subsequent period of days. Each tray preferably contains food items preselected for providing a complete meal.

8 Claims, 9 Drawing Figures

FREEZER/REFRIGERATOR AND REMOVABLE FOOD MODULE FOR USE THEREIN

BACKGROUND AND SUMMARY OF THE INVENTION

This invention relates to a refrigerating apparatus, and, more particularly, to a freezer/refrigerator (herein termed merely refrigerator) including a refrigerator compartment and a removable food module adapted for being received therein.

Conventional meal planning and preparation, as well as food budgeting, is difficult for many people. For example, such problems are posed for the retired, shut-ins, the handicapped, those with specific dietary regimens or needs, as well as others such as persons in various occupations, businesses and professions who have relatively little available time in which to carry out customary shopping, organization of foods, budgeting, planning, and the assembly of food dishes from the items so obtained.

Such persons are benefitted by the pre-planned meals of the commercial nature which are now available in the frozen food departments of present day grocery stores. In fact, many such persons have come to depend, or have been forced to rely upon, the commercial availability of such frozen products, including whole meals, sometimes having various preselected food items.

On the other hand, the commercial sale of frozen foods does not obviate all of the problems for such a person since it is still required to visit a food store, select the various items, carry out meal planning, budgeting and, in general, to determine the suitability of the various frozen items to be purchased based upon the price, content and selection available. Many such persons find even these tasks difficult if not impossible.

Accordingly, it is an object of the present invention to provide a refrigerating system, including a refrigerator, such as of the type utilizable for home frozen food storage, including a module for same, for modularized storage of foods in a fresh condition for a period of days.

It is a further object of the present invention to provide such a system wherein the food may be maintained in trays in a freshly frozen state within the module, being organized in tray compartments according to each of a multiplicity of consecutive days in the period, whereby the trays may be withdrawn by the user on subsequent days without prior planning, selection, budgeting or other effort on the part of the user.

It is also an object of the present invention to provide such a system wherein the entire module may be installed into the refrigerator to permit trays to be withdrawn readily from the module after it is installed, and to permit the module subsequently to be withdrawn and replaced by another module having a fresh load of food trays.

Another object of the invention is the provision of such a refrigerator having storage not only for the module within a freezer compartment thereof, but also providing refrigerated storage for other items in addition to the module.

It is further an object of the present invention to provide a new concept of family living wherein meal planning and food budgeting for the retired, shut-ins, and others having little available time or capability for normal planning, budgeting and food selection, are provided by modularized storage of food, and specifically frozen storage thereof according to trays configured and stored for withdrawal on each of a multiplicity of consecutive days within a period, and wherein each of the tray compartments is configured for holding multiple trays for each such days, the trays having preselected food items for providing a complete meal.

Among further objects of the invention may be noted the provision of such a module, or so-called capsule, which is lightweight, easy to handle, portable, is made of lightweight materials for durability, strength, ease of handling and long and reliable usage.

Briefly, the invention contemplates a refrigerator having a front door and at least one refrigerated module compartment, which may be located within a freezer portion of the refrigerator, which compartment is accessible when the front door is open, coupled with a removable food module in the form of a capsule adapted for being received within such compartment. The module includes a plurality of tray compartments corresponding to each of consecutive days in a period, such as a week, and with each compartment being marked with indicia for designating the days in a period corresponding to the respective tray compartments. Each such tray compartment is configured for holding at least one such tray having food for preparation on the day designated for such tray compartment. Accordingly, the module may be removed at the end of the period and replaced with a like module having a fresh supply of food for a subsequent period of days.

Other objects and features will be in part apparent and in part pointed hereinbelow.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
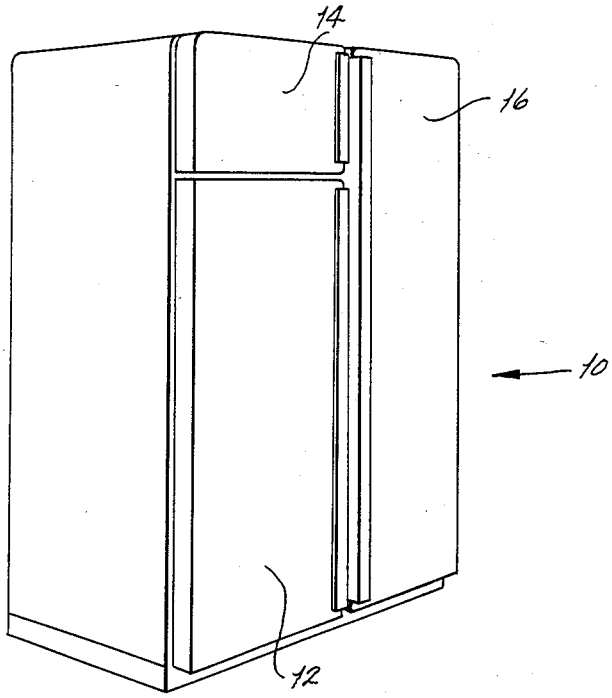
FIG. 1 is a perspective view of a refrigerator, and specifically a freezer/refrigerator for domestic use, configured in accordance with and embodying the present invention.

Referring to the drawings by reference characters, designated generally at 10 is a freezer/refrigerator, or what generically may be termed a refrigerator, and is so referred to herein, including a front door 12 opening into a lower freezer compartment, an upper door 14 opening into an upper freezer compartment, and a narrower door 16 opening into a compartment for maintaining of foods in unfrozen condition. Refrigerator 10 is of an upright configuration for purposes presently appearing, as of the type utilized domestically and in like commercial applications. In accordance with the invention, refrigerator 10 is specially configured for receiving a replaceable food module or capsule as described hereinbelow, in order to provide a new system wherein the entire module may be installed in the refrigerator to permit trays of food therein to be readily withdrawn from the module after it is so installed and, after the food has been consumed, permitting the module subsequently to be withdrawn and replaced by another module having a fresh load of food trays.

Figure 2:
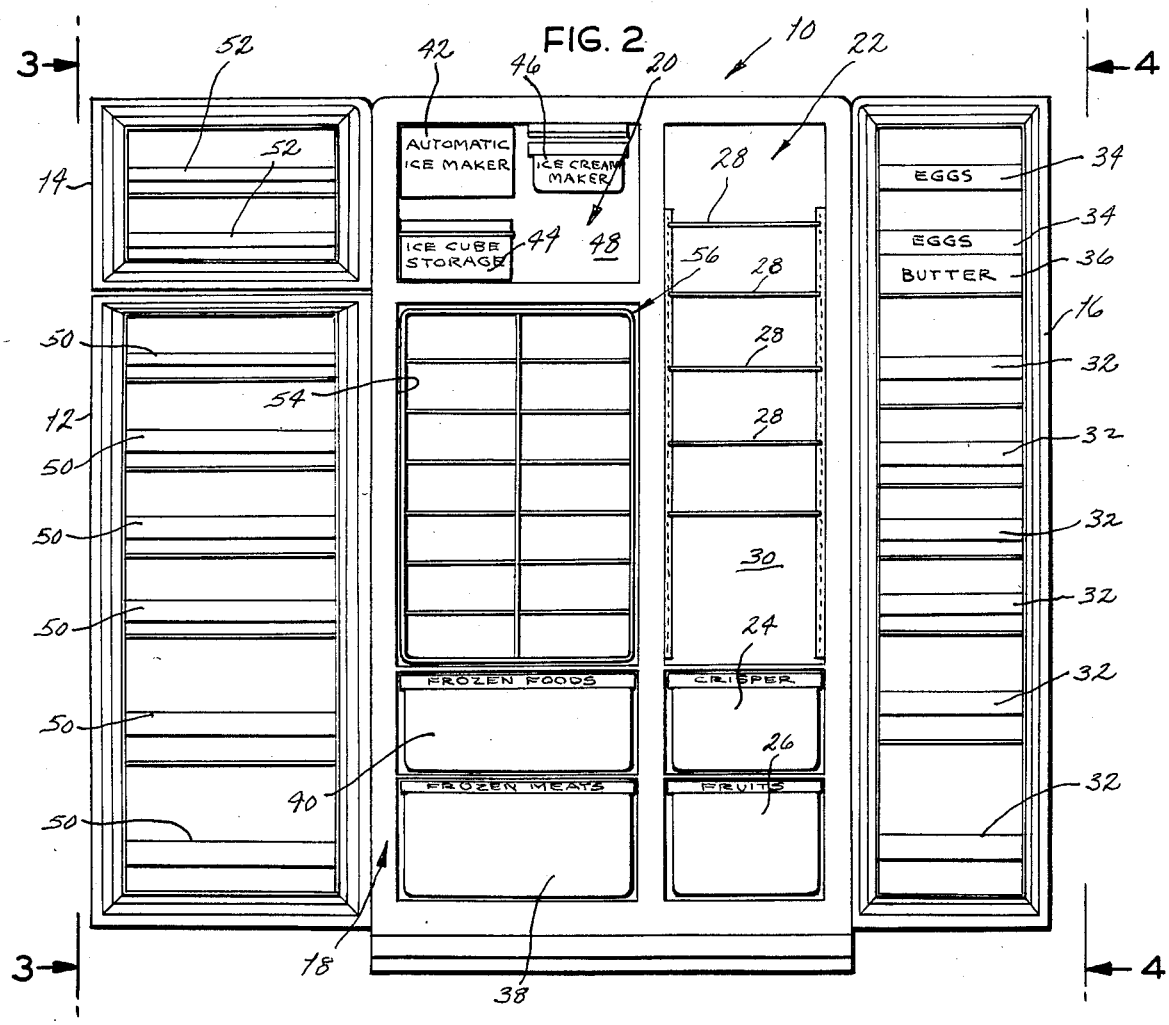
FIG. 2 is a front elevation view of the refrigerator of FIG. 1, with doors thereof open to illustrate a module-receiving compartment therein, as well as other compartments and storage areas for containment of both frozen and unfrozen food items.

More specifically, and referring to FIG. 2, refrigerator 10 has a left-hand freezer section including a lower section generally designated 18 for being closed by door 12 and an upper section designated generally 20 which access is gained through door 14.

A right-hand section, generally designated 22, for containment of food items at above-freezing temperature, is rendered accessible through door 16. It may include a conventional crisper drawer 24 such as for containment of vegetables, including celery, lettuce and the like, and may include a lower drawer 26 for containment of fruits and the like. A variety of shelves 28 permit storage of boxed food items, and with there being a space 30 for receipt of taller items such as bottles and the like. Door 16 is provided with conventional shelves, as at 32 for receipt of smaller items, such as small bottles, condiments and so forth, and includes also egg trays as at 34 and a butter compartment 36.

Similarly, at the bottom of the lower freezer compartment 18 is provided a frozen meat drawer 38 and a generalized frozen food drawer 40 such as for receipt of fresh frozen vegetables and the like.

The upper compartment 20 includes a conventional automatic ice maker 42 and ice cube storage therefor 44, an ice cream maker 46 and additional space 48 for receipt of smaller frozen items, such as bulk packages of ice cream, desserts, and so forth.

Door 12 is provided with shelves 50, while upper door 14 similarly includes shelves 52, again for the usual purpose of storage of smaller frozen items. As will be apparent, the lower section 18, being intended for longer term storage of frozen food items, is maintained at a lower temperature than upper section 20, the temperature of which would be more appropriate for the containment of ice cream as well as maintenance of ice cubes at a temperature appropriate for immediate usage.

A relatively large rectangular compartment 54 is provided centrally of the frozen food section of refrigerator 10, being of rectangular configuration and of relatively greater height than width, for receiving a food module, generally designated 56, of the invention. There are no intervening structures, shelves, projections or other items which intrude into the space of the module compartment 54, permitting the module 56 to be inserted therein with relatively little clearance at its top and side.

In accordance with the invention, said module 56 is insertable as a unit in compartment 54, and may be replaced in accordance with the intended mode of usage.

Figure 3:
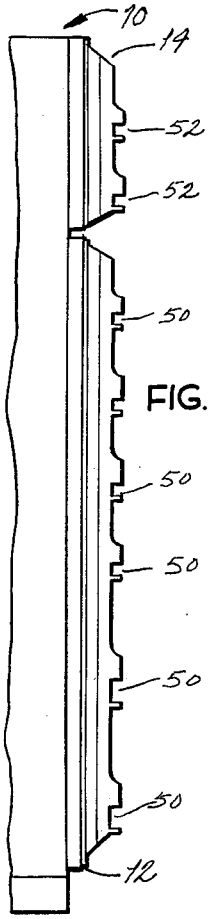
FIGS. 3 and 4, respectively, are side elevations as taken along lines 3—3 and 4—4 of FIG. 2.
Figure 4:
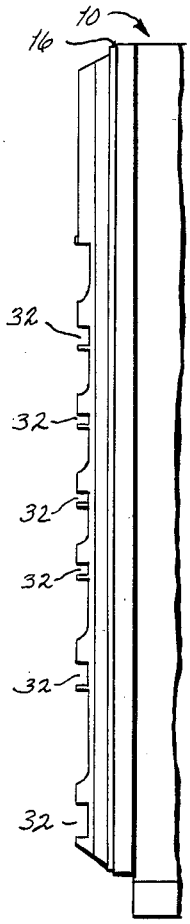

FIGS. 3 and 4 illustrate the generalized structure of doors 12, 14 and 16, and their shelves.

Figure 5:
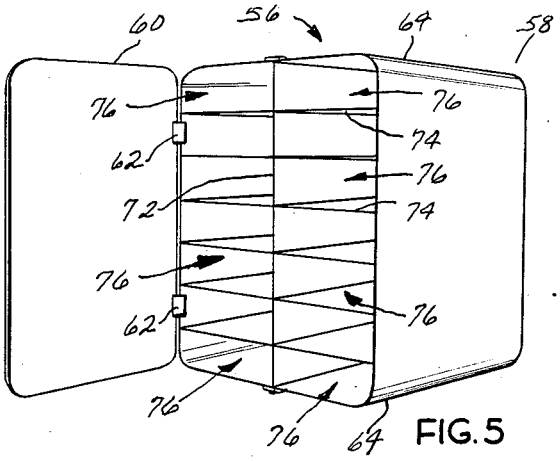
FIG. 5 is a perspective view of a food module or capsule in accordance with the present invention.
Figure 6:
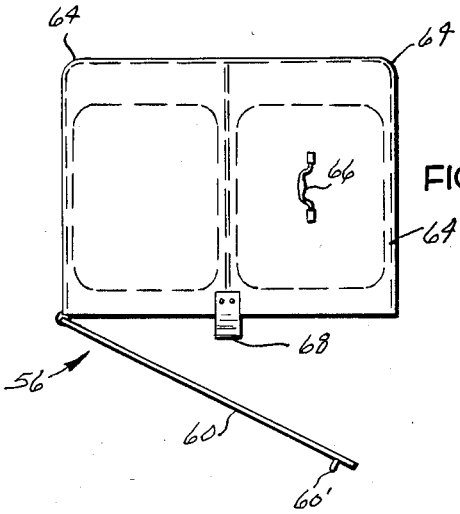
FIG. 6 is a top plan view of the food module of FIG. 5, with its front door being partly open as shown also in FIG. 5.

Referring to FIG. 5, module 56, which may be thought of as a capsule, is of generally rectangular configuration, being provided with a main body portion 58 to which a front door 60 is connected by a pair of hinges 62. The various corners, as at 64, of body 58 are rounded to avoid any sharp edges, protrusions or structure which could snag the clothing or interfere with rapid movement and handling of the module. This is consistent with the intended mode of usage, namely that such module 56 is to be replaced when the food items therein have been comsumed and replaced by another module.

Said main body portion 58 may be formed of a single piece of molded synthetic resin material, such as "Lexan", ABS, PVC or the like, or may be formed of stainless steel or aluminum alloy, the door 60 being formed of comparable material, in order to provide a lightweight, strong and durable construction which will readily survive the rigors of vigorous handling, as well as stacking, storage, and so forth. Lightweight aluminum alloy is most preferred.

Figure 8:
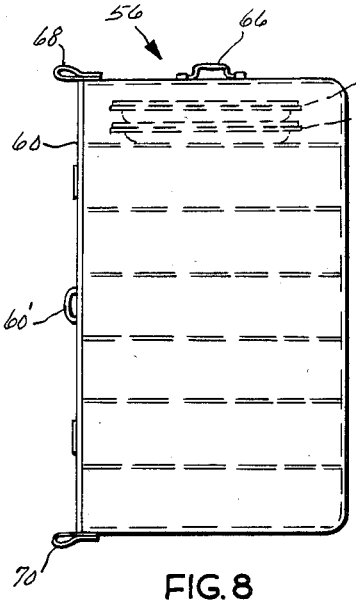
FIG. 8 is a side elevation view of the food module of FIG. 5, as viewed from the right side of FIG. 7.

For transportation of the module, a handle 66 is provided atop the main body portion 58, and a strap handle or loop-type tab 68 is secured centrally atop the main body portion 58 to protrude slightly above the door 60 when closed, as shown in FIG. 8, and permitting module 56 to be rapidly withdrawn from its compartment 54 when it is to be replaced. Similarly, a strap-type handle or tab 70 is provided at the lower edge of the body portion, whereby both of the handles 68, 70 may be readily grasped to withdraw the module from its compartment, whereupon it may be transported readily by use of handle 66.

Referring again to FIG. 5, it is seen that the interior of module 58 is divided by a central wall 72 into left and right halves, each of which is provided with shelves, as at 74, and whereby use of the halves is divided into a plurality of tray compartments 76, thereby are such compartments on both sides of said central vertical wall 72. Such shelves 74 as well as wall 72 may be formed of the same kind of material as for the main body 64 and door 60. Door 60 has a handle 60', to aid opening.

Figure 7:
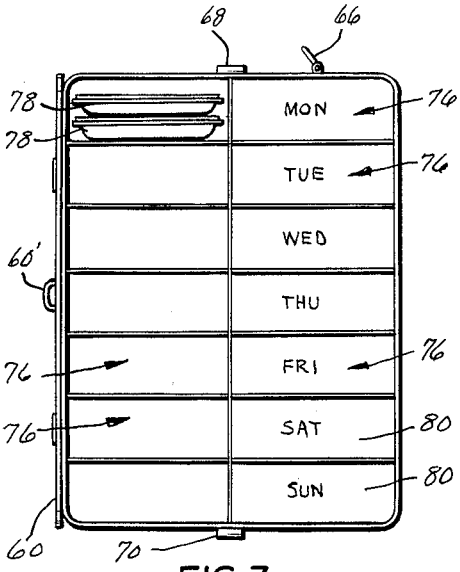
FIG. 7 is a front elevation view of the food module of FIG. 5, the door being open, to illustrate the storage of food trays therein.

Each of said compartments 76 is adapted to hold a plurality of food trays, such as at least two or more, such as the trays designated at 78 in FIG. 7, with the trays being stacked.

As is shown in FIG. 7, there are preferrably at least seven such tray compartments on each side of the central wall 72, whereby they may correspond to the days of the week, and are so designated by indicia, as at 80 applied to the back wall of said main body portion 58 or alternatively marked upon door 60. Thus, the user of the new refrigerator 10 is provided with an indication of the day of the week for consumption of the food products contained upon trays 78 in the respective compartments.

Figure 9:
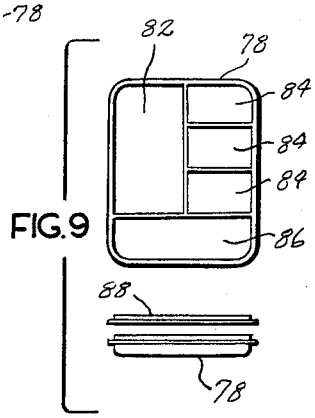
FIG. 9 is a series of views of a food tray for containment in the module of FIG. 5.

Referring to FIG. 9, each such tray 78 is divided into different sections, such as a main or entree section 82, smaller sections as at 84 for vegetables or desserts, etc. and a longer portion 86 for other food items, and/or for silverware and the like. Preferrably also, a lid 88 is formed for each such tray 78 to close it in a relatively sanitary, hermetic mode, and permitting also stacking of trays without contact of the various food items carried by each tray.

Most preferrably, each such tray 78 is of a non-metallic material, such as a temperature-resistant synthetic resin material, permitting heating of food items on a tray by microwave oven heating, whereby the entire tray with the different food items thereon preselected for providing a complete meal are conveniently and readily heated, but the food items remain separated by virtue of the various compartments 82, 84 and 86.

In use, a person who is retired, handicapped or a shut-in, may subscribe to a service or be entitled to the services of an agency which will supply filled modules 56 with the trays 78 therein already filled with preselected food items, and categorized according to the days of the week upon which trays are to be withdrawn upon consecutive days of the week. Since each tray compartment 56 holds at least one such tray 78, and conceivably several, one or more persons of a family may similarly have food conveniently organized and preselected according to the dietary requirements and/or preferences. Thus, in the case of a low sodium diet, one person may utilize food trays which are provided on the left side of wall 72, and another person who is on a normal diet, or perhaps another diet such as one with controlled sugar intake, as preferred for a diabetic diet, may utilize trays withdrawn from the right hand side of wall 72. Thus, the user having been provided with refrigerator 10, specially configured and equipped for receiving module 56, may have a new module 56 installed in the refrigerator upon a weekly basis. Additionally, extensive storage for other items which may be appropriate to the diet, such as miscellaneous frozen foods and/or meats, as well as vegetables and beverages, together with fresh items such as eggs, butter and the like, are also conveniently housed in the same refrigerator. In other words, it provides not only for rapid and convenient containment of module 56, and replacement thereof, but is also utilized in its more conventional mode for storage of the various frozen and unfrozen food items which may be required. In replacement of the module by a service or agency, as above described, the various other items may be also added, in bulk fashion, to the various trays, such as 38, 40, and 24, 26 to make up a complete complement of the foods that may be expected to be consumed over a period such as a week or more.

It will thereby be seen that refrigerator 10 takes on its customary role for containment of various food items, both frozen and unfrozen, and may be utilized in a conventional fashion for other persons in a household, while one person with a special dietary need may consume the food items organized according to the days of the week in the horizontally and vertically divided tray compartments, and so that the dietary needs of such individual may be met on a day-to-day basis while, at the same time, other users in a household may have food prepared from other items stored elsewhere in refrigerator 10.

Accordingly, the invention will appeal not only to those whose limitations preclude ordinary and customary shopping, organization of food, budgeting planning, and assembly of food dishes from the items so obtained, but also those persons whose situation makes such steps difficult or who have little time for same.

In view of the foregoing, it will be seen that the several objects of the invention and other advantages are achieved by the new constructions which have been described.

Although the foregoing includes the description of the best mode of the embodiments contemplated for carrying out the invention, various modifications are contemplated.

As various modifications could be made in the constructions herein described and illustrated without departing from the scope of the invention, it is intended that all matter contained in the foregoing description or shown in the accompanying drawing shall be interpreted as illustrative rather than limiting.

What is claimed is:

1. For use with a domestic refrigerator having a front door and providing at least one refrigerated module compartment accessible when the door is open, a removable and replaceable food module adapted for being received within the module compartment, the module comprising a plurality of tray compartments corresponding to each of a multiplicity of consecutive days in a period, the tray compartments being configured for holding multiple trays, each tray containing food items preselected for providing a complete meal, indicia for designating the days in the period corresponding to respective tray compartments, trays for such tray compartments, the trays being of nonmetallic material permitting heating of the food on the tray by microwave oven heating, each tray compartment being configured for holding at least one such tray having food for preparation on the day designated for such tray compartment, the module having a door for closing the module for sanitary enclosure of food-filled trays therein, first handle means at the front of the module for permitting withdrawal of the module from the module compartment, and second handle means atop the module for permitting lifting of the module for transportion of the module, whereby the module may be removed at the end of the period and replaced with a like module containing food for a subsequent period of days.

2. A food module according to claim 1, the trays being stackable within each tray compartment.

3. A food module according to claim 1, the trays each having a plurality of food compartments for food item separation within the tray.

4. A food module according to claim 1, the module being of lightweight aluminum and of generally rectangular configuration.

5. A food module according to claim 3 wherein the module is divided vertically into tray compartments.

6. A food module according to claim 5 wherein the module is divided horizontally also into such tray compartments.

7. A food module according to claim 5 wherein the vertical dividing corresponds to days of the week.

8. In combination, a domestic refrigerator having a front door including a plurality of refrigerating compartments for containing conventional food items and at least one separate refrigerated module compartment accessible when the door is open, a removable and replaceable food module adapted for being received within the module compartment, the module comprising a plurality of tray compartments corresponding to each of a multiplicity of consecutive days in a period, indicia for designating the days in the period corresponding to respective tray compartments, trays for such tray compartments, each tray compartment being configured for holding at least one such tray having food for preparation on the day designated for such tray compartment, the module having a door for providing selective access to the tray compartments whereby the module may be removed at the end of the period and replaced wtih a like module containing food for a subsequent period of days, each tray containing food items preselected for providing a complete meal.

* * * * *